US008587416B2

(12) United States Patent
Rajagopal

(10) Patent No.: US 8,587,416 B2
(45) Date of Patent: Nov. 19, 2013

(54) LOCATING REMOTE CONTROL DEVICES UTILIZING BASE UNIT POSITIONING

(75) Inventor: Harish Nair Rajagopal, Trivandrum (IN)

(73) Assignee: Sling Media Pvt Ltd, Bangalore (IN)

( * ) Notice: Subject to any disclaimer, the term of this patent is extended or adjusted under 35 U.S.C. 154(b) by 475 days.

(21) Appl. No.: 12/905,278

(22) Filed: Oct. 15, 2010

(65) Prior Publication Data

US 2012/0056715 A1 Mar. 8, 2012

(51) Int. Cl.
*G08B 21/00* (2006.01)

(52) U.S. Cl.
USPC ..... 340/12.23; 340/12.22; 340/12.24; 340/426.13; 340/4.11; 341/176; 348/734; 342/56

(58) Field of Classification Search
USPC ..... 340/426.13, 426.14, 4.11, 12.22–12.26, 340/539.2, 539.21, 539.32, 8.1; 341/176; 348/734; 342/56, 386, 443
See application file for complete search history.

(56) References Cited

U.S. PATENT DOCUMENTS

| | | | | |
|---|---|---|---|---|
| 2003/0085814 | A1* | 5/2003 | Griep | 340/825.72 |
| 2008/0143482 | A1* | 6/2008 | Shoarinejad et al. | 340/10.1 |
| 2009/0002217 | A1* | 1/2009 | Kryze et al. | 341/176 |
| 2010/0095346 | A1* | 4/2010 | Pal | 725/151 |
| 2010/0245113 | A1* | 9/2010 | Schmehl et al. | 340/825.49 |

* cited by examiner

*Primary Examiner* — Mohammad Ghayour
*Assistant Examiner* — Mark Rushing
(74) *Attorney, Agent, or Firm* — Kilpatrick Townsend & Stockton LLP

(57) ABSTRACT

A base may locate a remote control by transmitting a first location signal, receiving a second location signal at base receivers from a remote control device transponder transmitted in response, and calculating a location of the remote control device based on the received second location signal. The base may provide navigation information based on the calculated location. In some implementations, the base may perform a setup routine by providing an interface that accepts position information, accepting an indication that the remote control is located at a position, transmitting a first calibration signal, receiving a second calibration signal at the receivers transmitted by the transponder in response, and recording baselines for the position. When the base unit subsequently analyses a second location signal to calculate a location of the remote control, the base may base the calculated location at least partly on the baselines.

15 Claims, 10 Drawing Sheets

LOCATING REMOTE CONTROL DEVICES UTILIZING BASE UNIT POSITIONING

RELATED APPLICATIONS

The present application claims the benefit under 35 U.S.C. §119(b) to Indian Patent Application No. 2556/CHE/2010, which was filed on Sep. 2, 2010, in the Indian Patent and Trademark Office, and entitled "Locating Remote Control Devices Utilizing Base Unit Positioning," which is incorporated by reference into the present application in its entirety.

FIELD OF THE INVENTION

This disclosure relates generally to remote control devices, and more specifically to base units locating associated remote controls utilizing signal positioning.

SUMMARY

The present disclosure discusses systems, methods, and computer program products for locating remote control devices by a base unit performing signal positioning. The base unit may transmit a first location signal to a remote control device. A plurality of receivers of the base unit may receive a second location signal transmitted by a transponder of the remote control device in response to the first location signal. The base unit may analyze the received second location signal to calculate a location of the remote control device and may then provide navigation information based thereon. The navigation information may describe a path from the base unit to the remote control device.

In various implementations, the location may be calculated by determining distance between the base unit and remote control device from the receipt time of the second location signal, the receipt strength of the second location signal, and so on. The location may also be calculated by determining direction between the base unit and remote control device from phase differences in the second location signal as received by different receivers of the base unit. Further, the location may be calculated by a combination of determining distance from the receipt time and receipt time and determining direction from the phase differences.

In some implementations, the base unit may be operable to perform a setup routine to record baseline measurements for locating the remote control device. The base unit may provide an interface that accepts information about positions within a location from a user. The base unit then accepts an indication from the user that the remote control device is located at one of the positions. In response to receiving the indication, the base unit transmits a first calibration signal to the remote control device, receives a second calibration signal transmitted by a transponder of the remote control device in response to the first calibration signal, and records baseline measurements for the position regarding the received second calibration signal. When the base unit subsequently analyses a second location signal to calculate a location of the remote control device, the base unit compares the received second location signal to the baseline measurements to identify whether the remote control device is located at one of the identified positions at the location.

In one or more implementations, the transponder of the remote control device may be powered by a power supply other than a power supply that powers the remote control device. The transponder may include a dedicated power supply. Alternatively, the transponder may be a passive radio-frequency identification tag that be passively powered by receiving the first location signal or the first calibration signal.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION OF THE EMBODIMENTS

Figure 1:
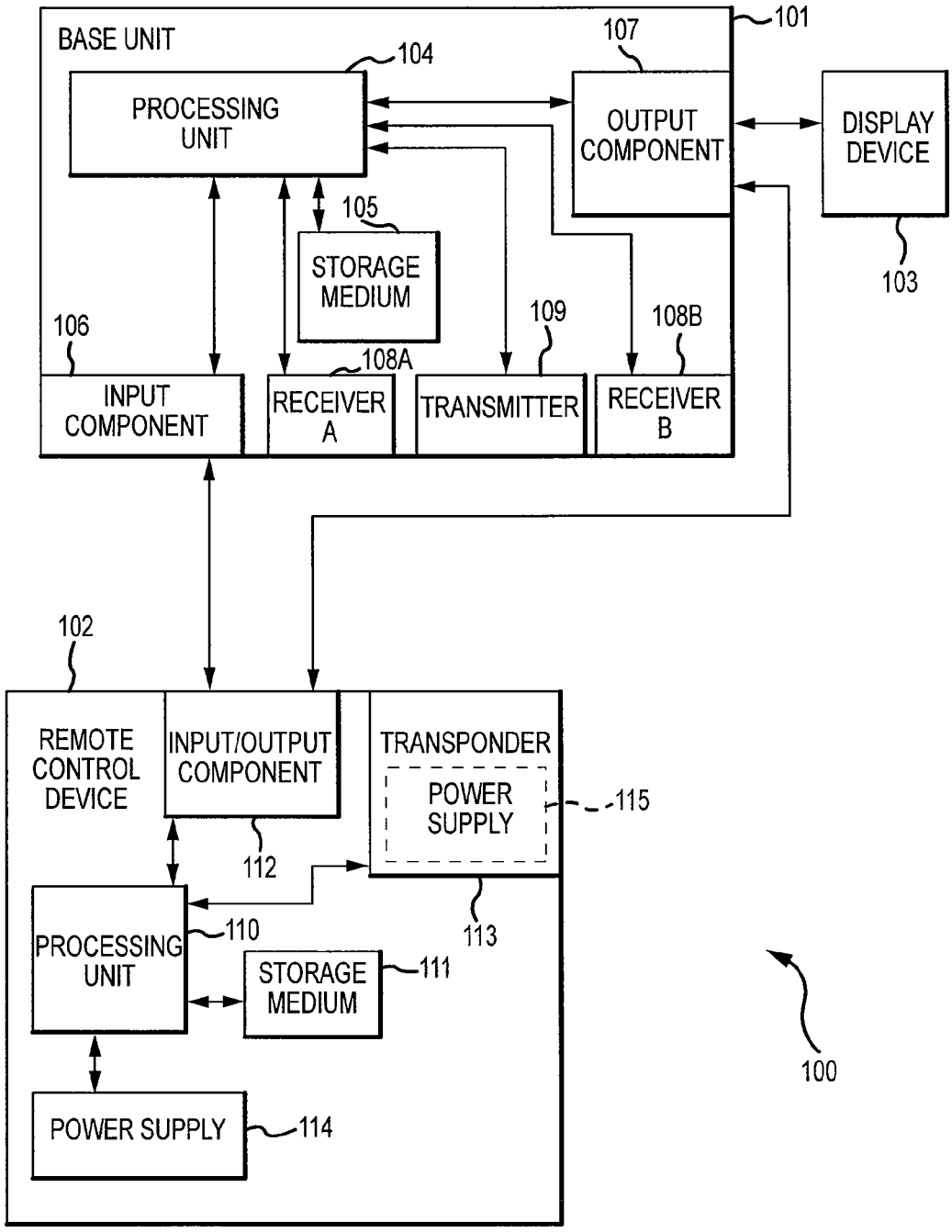
FIG. 1 is a block diagram illustrating a system for locating remote control devices with base units utilizing signal positioning.

The description that follows includes sample systems, methods, and computer program products that embody various elements of the present disclosure. However, it should be understood that the described disclosure may be practiced in a variety of forms in addition to those described herein.

Base units may include devices such as content receivers, set top boxes, cable boxes, digital versatile disc (DVD) players, video cassette recorders, compact disc (CD) players, radios, audio cassette players, digital video recorders, digital music players, personal computers, mobile computers, and so on. Typically, base units process and play content received from one or more content providers via one or more transmission media, such as one or more communication networks, one or more physical distribution networks, and so on. One or more remote control devices may be associated with a base unit. Such an associated remote control device may be utilized by a user to interact with the base unit and control one or more operations.

As remote control devices are typically operable to wirelessly interact with a base unit, a user may be able to control operations without being required to physically approach the base unit. This capability may allow the user to conveniently utilize the base unit from various positions within a location, providing the user a certain freedom of movement. However, due to this very freedom of movement, when the user desires to utilize the remote control device, he may not remember where he left it. As the user may have used the associated remote control device in a variety of positions within a location, the remote control device could be in any of those various places. The remote control device could be located in any number of different places that may be difficult for the user to find, such as under couch cushions or furniture, in another room, and so on. The user may have to search for the remote control device when he desires to operate the base unit, thus losing some of the very convenience that the remote control device provides.

The remote control device may be operable to play an audio sound (such as a buzz, a bell, and so on) to assist a user in locating the remote control device. In such an implementation, the user may use the base unit to signal the remote control device to play the audio sound. As the audio sound plays, the user may be able to follow the audio sound to the remote control device. However, the user may still be unable to locate such a remote control device if the user cannot hear the playing audio sound, if the remote control device has run out of battery power and cannot play the audio sound, and so on.

The present disclosure discloses systems, methods and computer program products for locating remote control devices utilizing signal positioning performed by a base unit. The base unit may transmit a first location signal to a transponder of a remote control device. In response to the first location signal, the transponder may transmit a second location signal to a plurality of receivers of the base unit. The base unit may analyze the second location signal received by the plurality of receivers to calculate a location of the remote control device. Subsequently, the base unit may provide navigation information which is based on the calculated location to a user via an associated display device. The user may be able to follow the navigation information in order to find the remote control device.

FIG. 1 is a block diagram illustrating a system 100 for locating remote control devices utilizing signal positioning performed by a base unit. The system 100 includes a base unit 101, a remote control device 102, and a display device 103. The base unit may be any kind of device that is associated with a remote control device, such a content receiver, a television receiver, a set top box, a cable box, a computer, a DVD player, a CD player, a radio, a digital video recorder, a digital music player, and so on. The base unit may include one or more processing units 104, a storage medium 105 (which may be any non-transitory machine-readable storage medium), one or more input components 106, one or more output components 107, a plurality of receivers 108A and 108B, and one or more transmitters 109. In some implementations, the processing unit may execute software instructions stored in the storage medium to process content that is received and/or content that is stored in the storage medium and play such processed content on an associated display device 105 (such as one or more televisions, speakers, computer monitors, and so on) via the output component (which may include a port with a hardwired connection to the display device).

The remote control device 102 may be any remote control device that is operable to wirelessly interact with the base unit 101. The remote control device may include one or more processing units 110, a storage medium 111 (which may be any non-transitory machine-readable storage medium), one or more input/output components 112, one or more transponders 113, and one or more power supplies 114 (such as one or more batteries). The remote control device may interact with the base unit. In interacting with the base unit, the processing unit may execute software instructions stored in the storage medium to transmit one or more signals to the base unit via the input/output component and the input component 106 and/or receive one or more signals from the base unit via the output component 107 and the input/output component. The remote control device may transmit signals to the base unit in response to user input received from one or more buttons or other selection elements (not shown) of the remote control device via the input/output component. The remote control device may perform one or more actions, such as displaying output on an associated display screen of the remote control device (not shown), in response to receiving signals from the base unit via the input/output device. Similarly, the base unit may be operable to perform one or more actions in response to receiving one or more signals from the remote control device via the output component.

The base unit 101 may also perform operations to locate the remote control device 102. The base unit may transmit a first location signal from the transmitter 109 to the transponder 113 of the remote control device. In some implementations, the transponder may be a radio-frequency identification tag. When the transponder receives the first location signal, the transponder may respond by transmitting a second location signal to the plurality of receivers 108A and 108B of the base unit. The base unit may then calculate a location of the remote control device. Based on the calculated location of the remote control device, the base unit may determine navigation information that describes a path from the base unit to the remote control device and display the navigation information on the display device 103. Thus, a user may be able to utilize the navigation information to find the remote control device.

As part of calculating the location of the remote control device 102, the base unit 101 may calculate a distance from the base unit to the remote control device, a direction from the base unit to the remote control device, a combination of these, and so on. For example, the base unit may calculate the direction from the base unit to the remote control device by comparing the phase of the second location signal received by one of the receivers 108A and 108B with the phase of the signal received by one or more other receivers. By comparing the difference in phase between the received signals, the base unit may be able to triangulate the direction of the remote control device from the base unit. Although the base unit is illustrated as having two receivers, it should be understood that more receivers may be utilized to increase the accuracy of the calculated direction.

By way of a first example of calculating distance, the base unit may compare the time that one or more of the receivers 108A and 108B receive the second location signal with a time that the base unit expected to receive the signal. The more that the actual receipt time exceeds the expected receipt time, the greater the distance may be between the base unit and the remote control device. Further, the time differences calculated by different receivers may be cross verified and correlated to reduce error. By way of a second example of calculating distance, the base unit may compare a strength of the second location signal received by one or more of the receivers with an expected strength of the signal. The weaker the actual received signal as compared to the expected signal, the greater the distance may be between the base unit and the remote control device. Further, the strength differences calculated by different receivers may be cross verified and correlated to reduce error.

The base unit 101 and the remote control device 102 may also interact to perform a setup routine to record baseline measurements the base unit may utilize to locate the remote control device. For example, the base unit may provide an interface via the output component 107 and the input component 106 that a user may utilize to provide information about positions within a location in which the remote control device will be used. For example, the user may provide a list of rooms in their home, a map of their home, and so on via the remote control device. The base unit may allow the user to indicate via the remote control device that the remote control device is currently located in a position the user has provided information about. In response, the base unit may transmit a first calibration signal to the transponder 113 from the transmitter 109, receive a second calibration signal at the receivers 108A and 108B transmitted by the transponder 113 in response to the first calibration signal, and record baseline measurements regarding the received second calibration signal. When the base unit then calculates the location of the remote control device, the base unit may compare information about a received second location signal with the recorded information to determine that the remote control device is located at one of the user specified positions. As such, the navigation information provided by the base unit may reference the user specified position.

Figure 2:
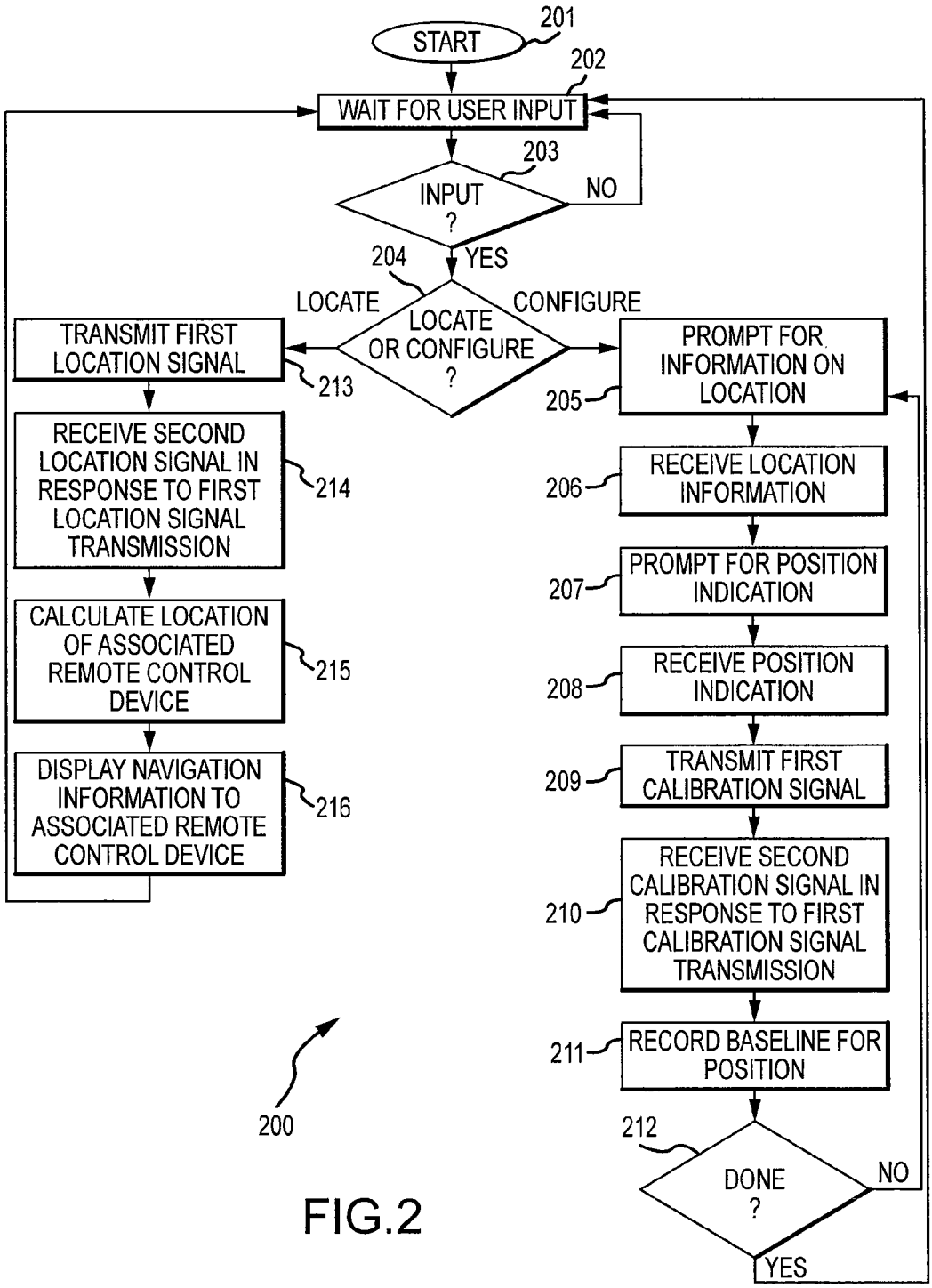
FIG. 2 is a flow chart illustrating a method for locating remote control devices with base units utilizing signal positioning. This method may be performed by the system of FIG. 1.

FIG. 2 illustrates a method 200 for locating remote control devices utilizing signal positioning performed by a base unit. The method 200 may be performed by the base unit 101. The flow begins at block 201 and proceeds to block 202 where the base unit waits for user input. The flow then proceeds to block 203 where the base unit determines if user input has been received. If so, the flow proceeds to block 204. Otherwise, the flow returns to block 202 where the base unit continues to wait for user input.

At block 204, the base unit 101 determines whether the user input specifies to locate the remote control device 102 or to configure location of the remote control device by performing the setup routine. If the base unit determines to locate the remote control device, the flow proceeds to block 213. However, if the base unit determines to perform the setup routine, the flow proceeds to block 205.

At block 205, the base unit 101 prompts the user for information on the location in which the remote control device 102 will be utilized. The flow then proceeds to block 206 where the base unit receives the information on the location. Next, the flow proceeds to block 207 where the base unit prompts the user to indicate the current position of the remote control device at the location. The flow then proceeds to block 208 where the base unit receives the indication of the current position of the remote control device. Next, the flow proceeds to block 209 where the base unit transmits a first calibration signal to the remote control device. The flow then proceeds to block 210 where the base unit receives a second calibration signal that was sent by the remote control device in response to receipt of the first calibration signal and the flow proceeds to block 211. At block 211, the base unit records a baseline measurement for the indicated position based on analysis of the received second calibration signal. The flow then proceeds to block 212 where the base unit determines whether the setup routine is finished. If so, the flow returns to block 202 where the base unit waits for user input. If not, the flow returns to block 205 where the base unit prompts the user for information on the location in which the remote control device will be utilized.

At block 213, after the base unit 101 determines at block 204 to locate the remote control device 102, the base unit transmits a first location signal to the remote control device. The flow then proceeds to block 214 where the base unit receives a second location signal that was sent by the remote control device in response to receipt of the first location signal. The flow then proceeds to block 215 where the base unit calculates the location of the associated remote control device and the flow proceeds to block 216. At block 216, the base unit displays navigation information that is determined based on the calculated location and describes a path from the base unit to the remote control device on an associated display device. Subsequently, the flow returns to block 202 where the base unit waits for user input.

Figure 3:
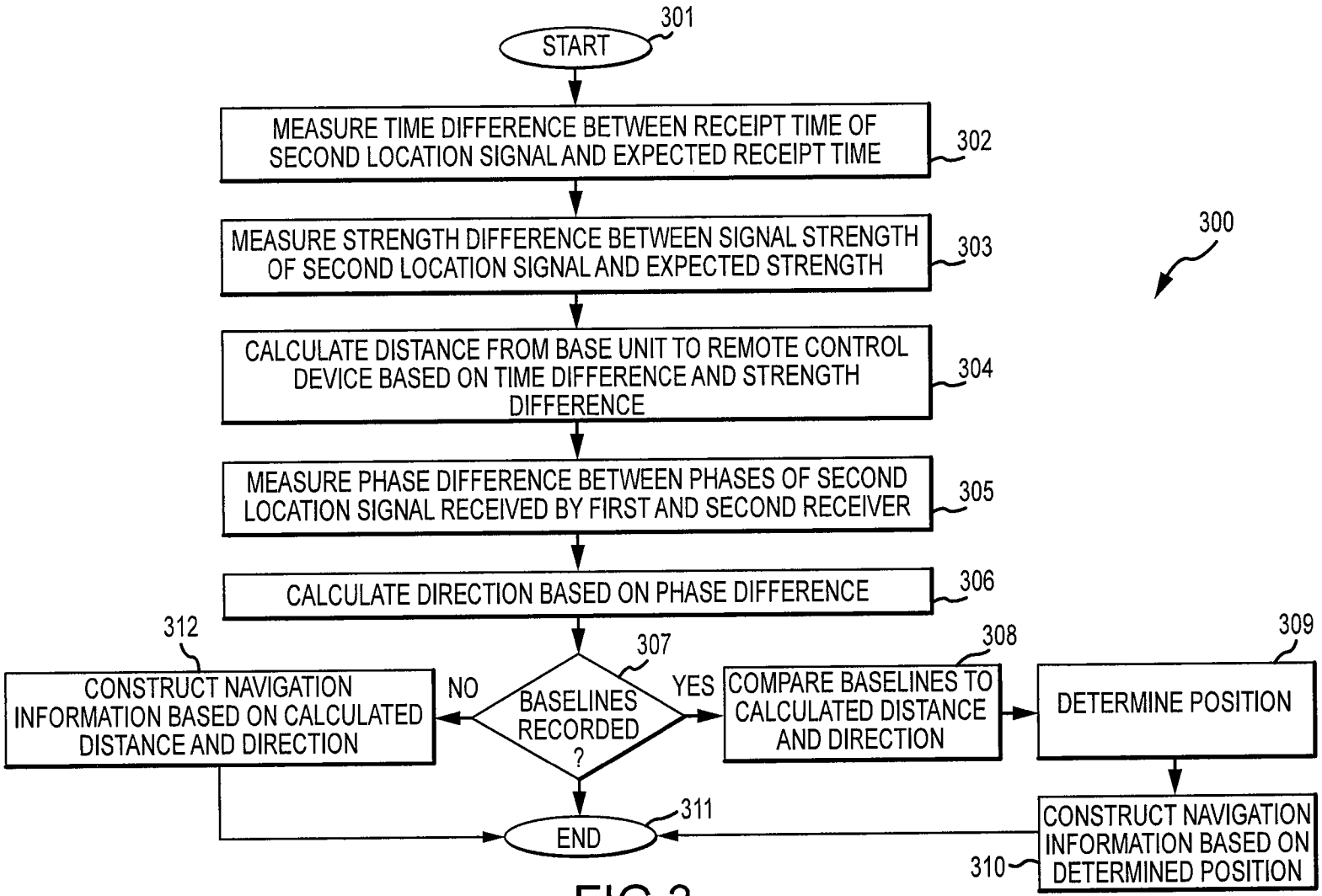
FIG. 3 is a flow chart illustrating a method for calculating a location of a remote control device. This method may be performed as part of the method of FIG. 2.

FIG. 3 illustrates a method 300 for calculating a location of a remote control device. The method 300 may be performed by the base unit 101 as part of performing block 215 of the method of FIG. 2. The flow begins at block 301 and proceeds to block 302 where the base unit measures a time difference between the receipt of a second location signal sent by the remote control device 102 in response to a first location signal sent by the base unit and a time the base unit expected to receive the second location signal. Although the time difference is described as calculated by a single receiver, multiple separate receivers may each calculate such a time difference and the multiple time differences may be cross verified and correlated to determine a single time difference and reduce error. The second location signal may be a digital or analog signal modulated on an analog carrier, a purely analog signal, and so on. The flow then proceeds to block 303 where the base unit measures a strength difference between the received second location signal and an expected signal strength. Although the strength difference is described as calculated by a single receiver, multiple separate receivers may each calculate such a strength difference and the multiple strength differences may be cross verified and correlated to determine a single strength difference and reduce error. Next, the flow proceeds to block 304 where the base unit calculates the distance between the base unit and the remote control device based on the time difference and the strength difference. The time difference may be used directly for calculating the absolute distance after reducing the time difference by an amount that corresponds to the time between the remote control device receiving the first location signal and transmitting the second location signal. The flow then proceeds to block 305.

At block 305, the base unit measures a phase difference between the phase of a second location signal received by one of the receivers 108A and 1088 and the phase of the second location signal received by another of the receivers 108A and 1086. Then, the flow proceeds to block 306 where the base unit calculates the direction between the base unit and the remote control device based on the phase difference. The flow then proceeds to block 307.

At block 307, the base unit determines whether baseline measurements for positions at a location have been recorded. If so, the flow proceeds to block 308. Otherwise, the flow proceeds to block 312.

At block 308, if baseline measurement for positions at a location have been recorded, the base unit compares the recorded baseline measurements to the calculated distance and direction. In addition, the base unit may also compare the recorded baseline measurements to the time difference, the strength difference, the phase difference, and so on. The flow then proceeds to block 309 where the base unit determines the position of the remote control device at the location based on the comparison. Next, the flow proceeds to block 310 where the base unit constructs the navigation information based on the determined position. The flow then proceeds to block 311 and ends.

At block 312, after the base unit determines that baseline measurement for positions at a location have been not recorded, the base unit constructs the navigation information based on the calculated distance and direction. In addition, the base unit may also construct the navigation information based on the time difference, the strength difference, the phase difference, and so on. The flow then proceeds to block 311 and ends.

In some implementations, the time between when the transponder 113 transmits the second location signal and the receivers 108A and 108B may be very small, such as a number of milliseconds. This may be due to the speed at which signals are transmitted by the transponder, the distance between the remote control device 102 and the base unit 101, and so on. In such a case, the base unit may not be able to accurately calculate distance based on the difference between an actual receipt time and an expected receipt time if the second location signal constituted only a single signal. As such, in such implementations the second location signal may be a pattern of a plurality of signals instead of a single signal and the actual receipt time may be the time between when the first signal of the pattern is received and when the final signal of the pattern is received. In this way a larger period of time may be measured to compare against an expected time in order for the base unit to more accurately determine the distance between the remote control device and the base unit.

The power supply 114 may provide power for the remote control device 102 to support performance of various operations. However, in various implementations, the transponder 113 may be powered by a power source other than the power supply 114. In some of these various implementations, the transponder may include a power supply 115 (such as one or more batteries) that is separate from the power supply 114 which powers the remote control device. In other implementations, the transponder may be a passively powered transponder such as a passive radio-frequency identification tag. In other words, the transponder may be activated and powered to send a response signal by receiving a signal such as the first location signal, the first calibration signal, and so on. Hence, the transponder may actually be powered by the receipt of the first location signal, the first calibration signal, and so on.

Figure 4:
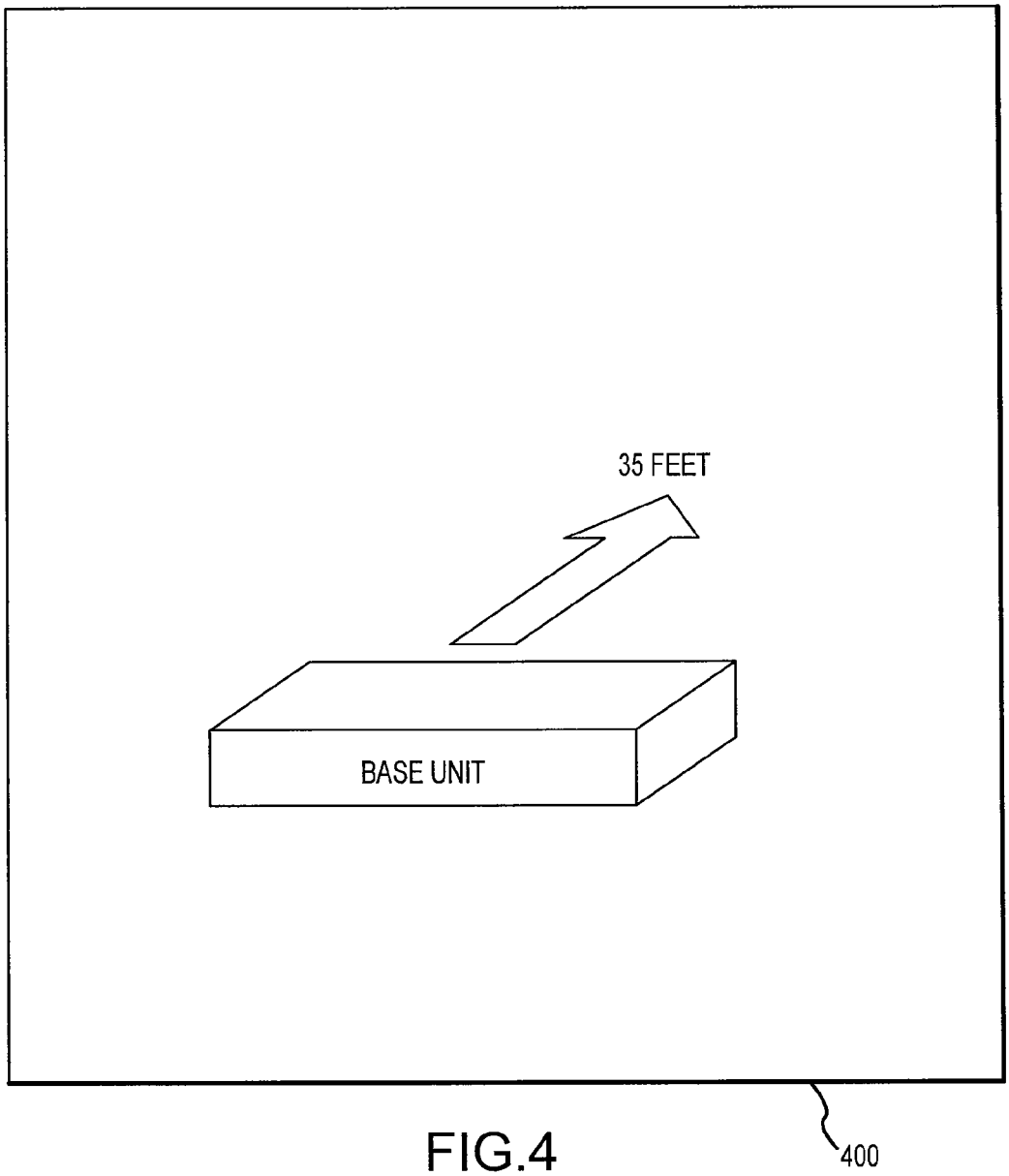
FIG. 4 illustrates a sample display screen depicting navigation information that may be displayed by the system of FIG. 1.
Figure 5A:
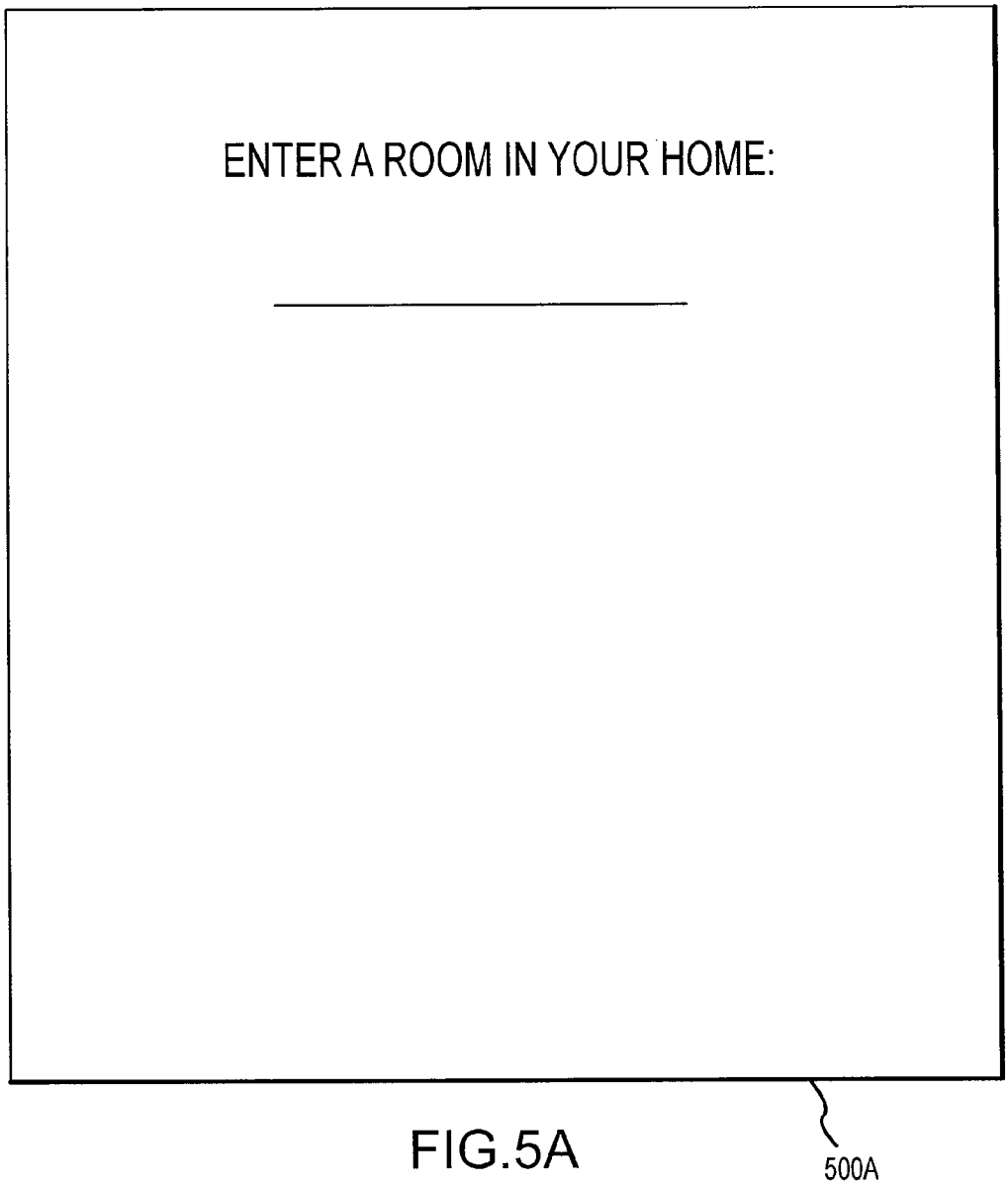
FIGS. 5A-5F illustrate sample display screens that may be displayed by the system of FIG. 1 while performing portions of the method of FIG. 2.
Figure 5B:
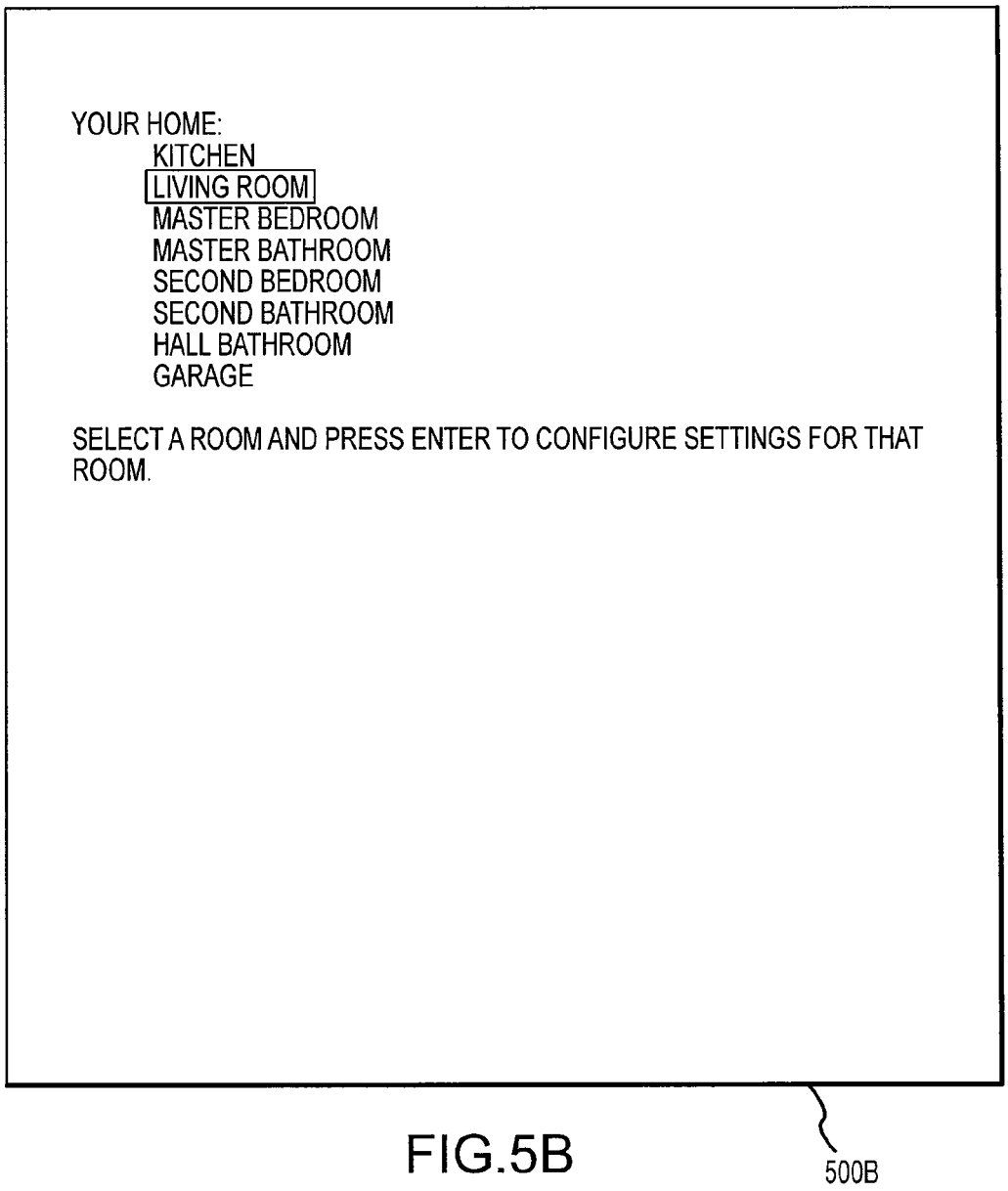
Figure 5C:
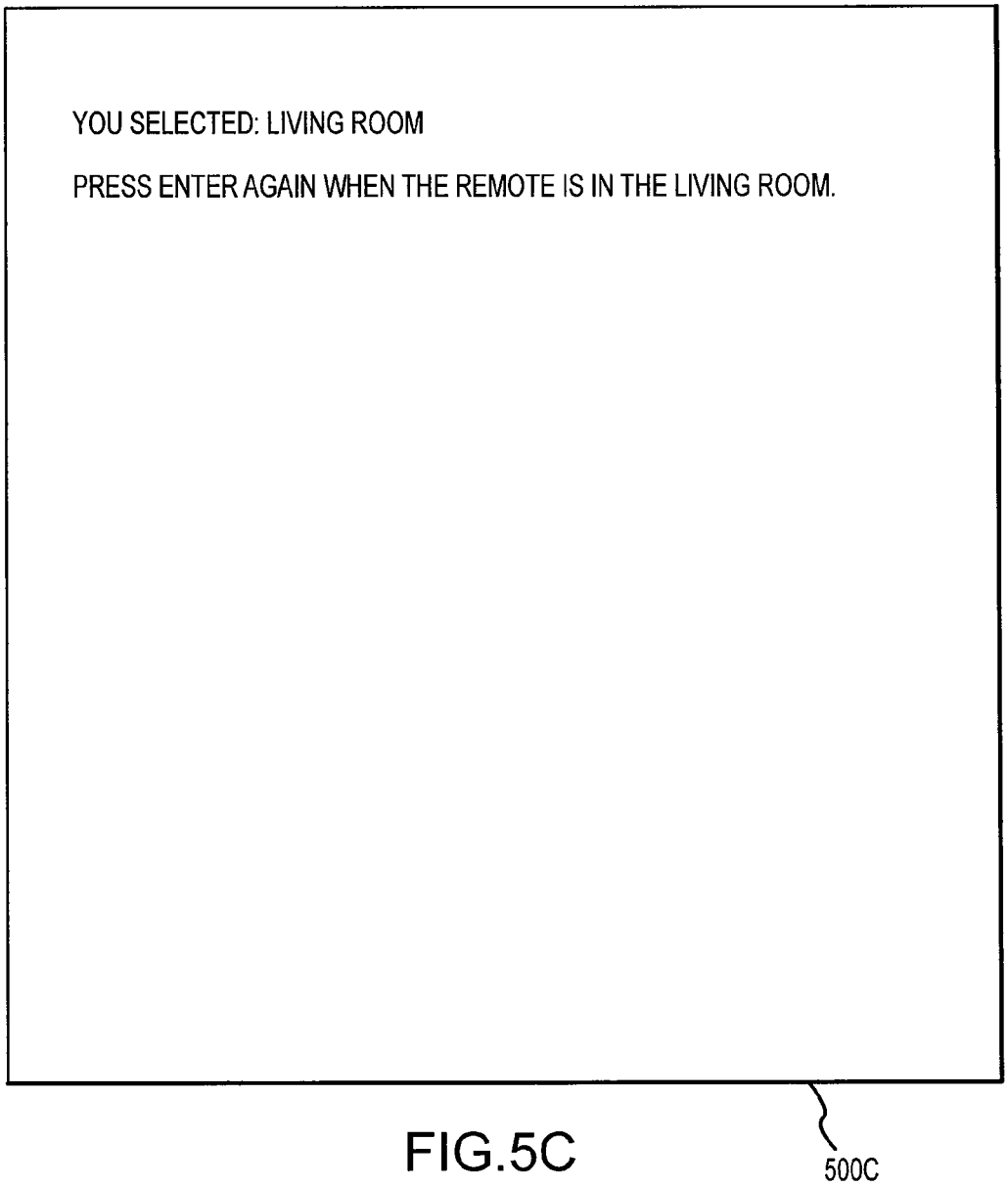
Figure 5D:
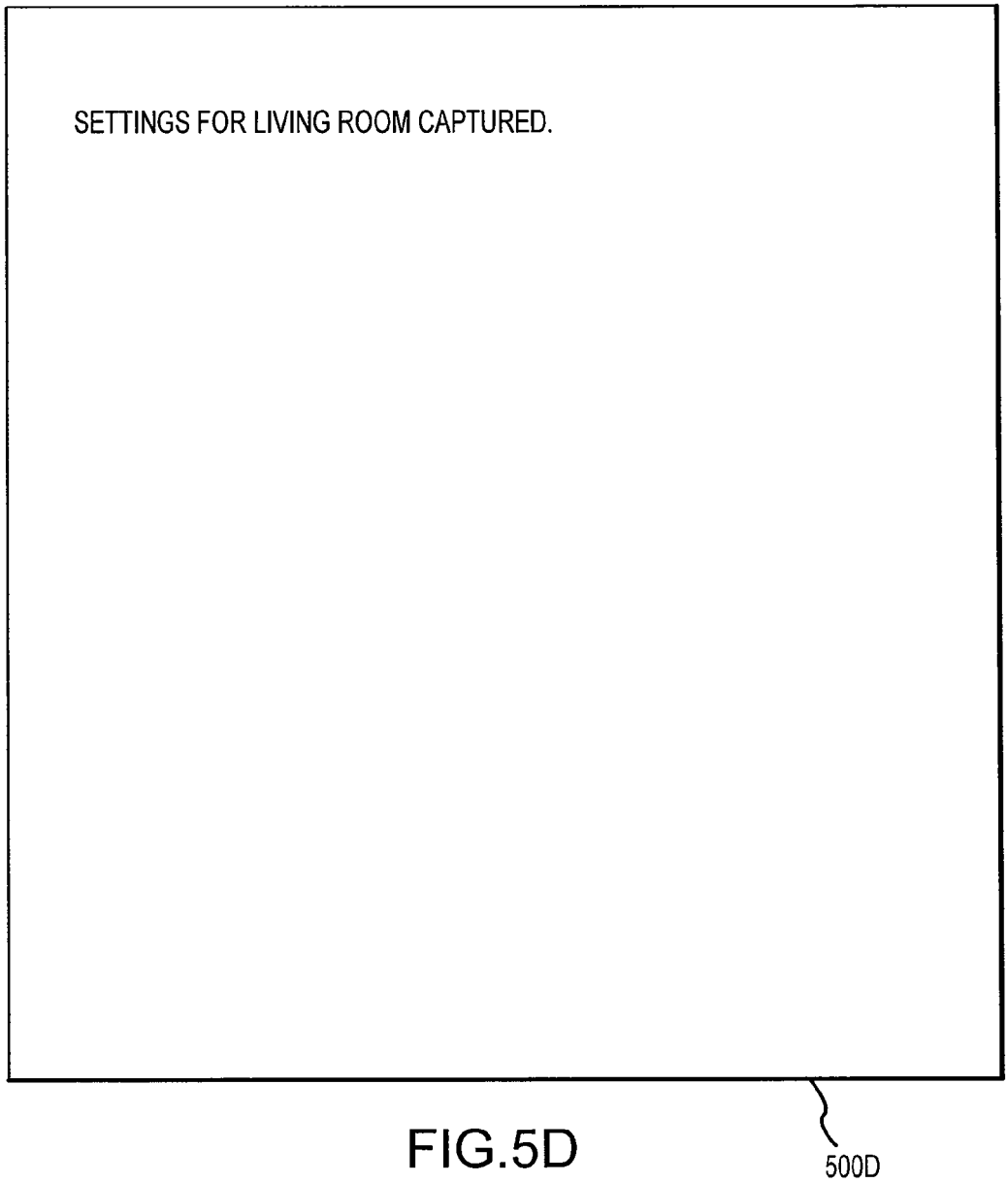
Figure 5E:
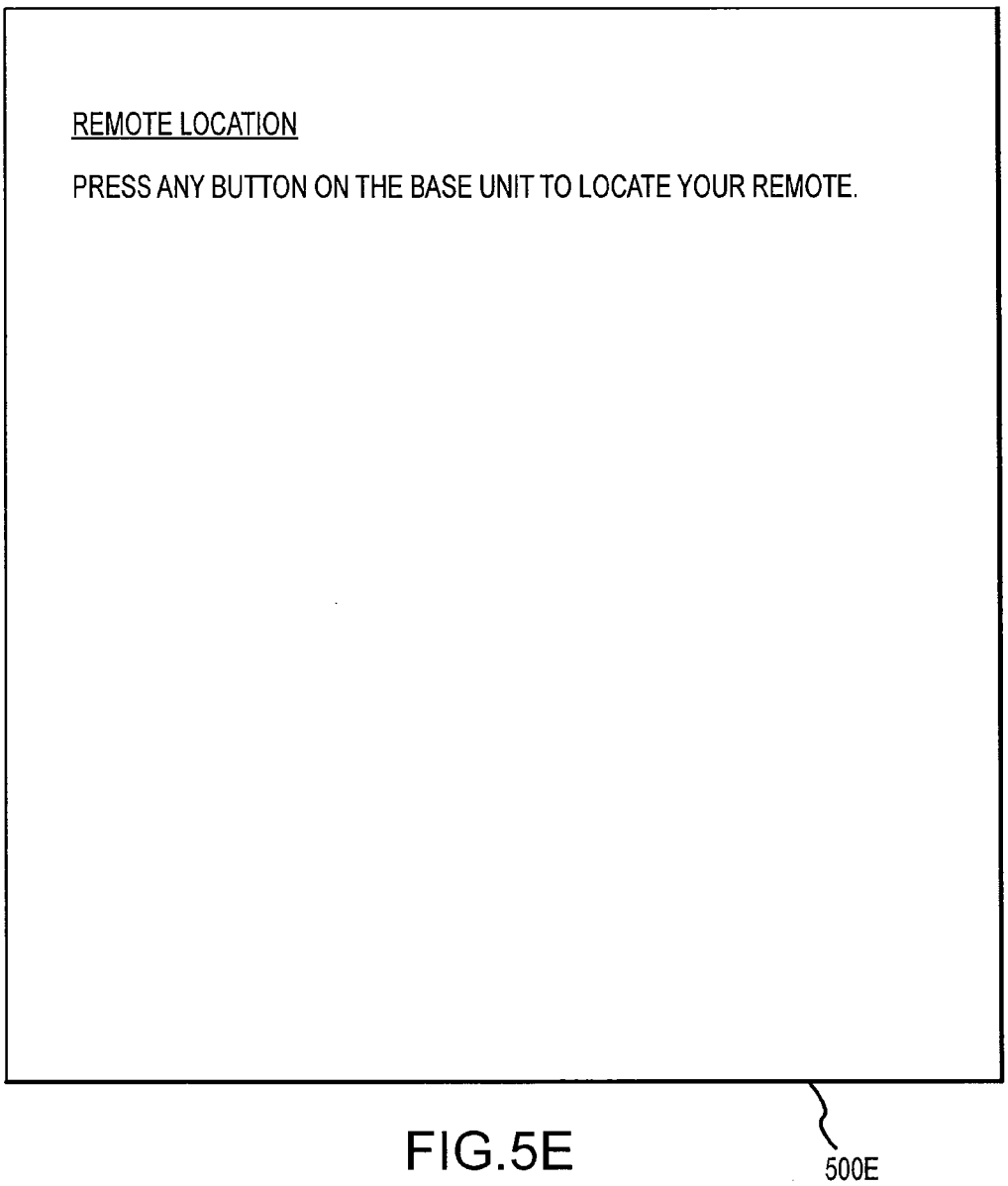
Figure 5F:
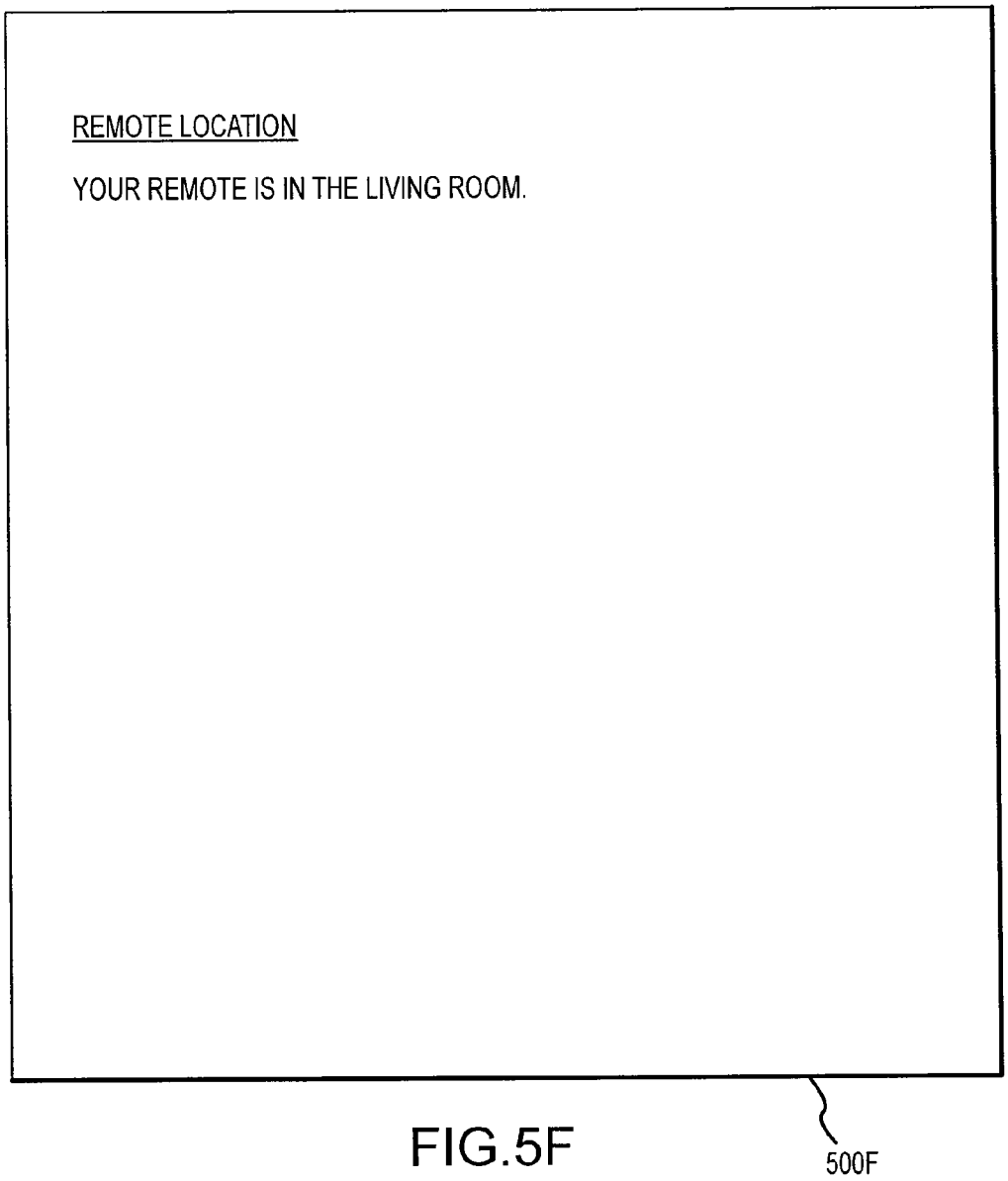

FIG. 4 illustrates a sample display screen 400 depicting navigation information that may be generated by the base unit 101 performing a first example of the method of FIG. 2. As illustrated, the base unit 101 calculated a distance and a direction between the remote control device 102 and the base unit. The base unit calculated the distance and direction based on a second location signal received by the transmitters 108A and 108B that was transmitted by the transponder 113 in response to a first location signal transmitted by the transmitter 109. The sample display screen 400 includes a representation of the base unit, a directional arrow, and a distance indicator. As depicted by these elements, the base unit calculated that the remote control device is thirty-five feet from the base unit in the direction indicated by the arrow. Hence, a user may travel thirty-five feet from the base unit in the indicated direction and find the remote control device.

FIGS. 5A-5F illustrate a sample display screens 500A-500F that may be generated by the base unit 101 performing a second example of the method of FIG. 2. Sample display screens 500A are display screens that may be displayed during a setup routine that records baseline measurements for various rooms in a users home. Sample display screen 500A is an image illustrating a prompt for the user to enter rooms in their home utilizing the remote control device 102. Sample display screen 500B is an image illustrating a prompt for the user to select one of the entered rooms for which to record baseline measurements. As illustrated, the user has entered information indicating that the user's home includes a kitchen, living room, master bedroom, master bath, second bedroom, hall bathroom, and garage. Sample display screen 500C is an image illustrating that the user has selected to record baseline measurements for the living room via sample display screen 500B. Also illustrated in 500C is a prompt for the user to take the remote control device to the living room and press enter, indicating to the base unit that the remote control device is currently present in the living room. Sample display screen 500D illustrates a message displayed to the user after the user has taken the remote control to the living room and pressed enter in response to the prompt displayed in sample screen 500C. As illustrated in sample display screen 500D, the base unit transmitted the first calibration signal in response to the user pressing enter on the remote control device, received the second calibration signal from the remote control device in response to the first calibration signal, and recorded baseline measurements from the received second calibration signal.

Sample display screen 500E illustrates a prompt for the user to press a button on the base unit to select the remote. In this example, baseline measurements have already been recorded for the rooms of the user's home (i.e., the kitchen, living room, master bedroom, master bath, second bedroom, hall bathroom, and garage) that were entered by the user. Sample display screen 500F illustrates a message displayed to the user after the user has pressed a button on the base unit in response to the prompt displayed in sample screen 500E. As illustrated in sample display screen 500F, the base unit transmitted the first location signal in response to the user pressing a button on the base unit, received the second location signal from the remote control device in response to the first location signal, compared the received second location signal to the recorded baselines, and determined that the remote control device is present in the living room based on the comparison. Hence, the message displayed on the sample display screen 500F indicates to the user that the remote is present in the living room and the user may travel there and find the remote control device.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a: magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

The invention claimed is:

1. A method for locating a remote control device, the method comprising:

receiving an indication to implement a setup routine for locating remote control devices at a residence utilizing signal positioning;

outputting for display a prompt that requests identification of a location within the residence that an associated remote control device is to be utilized;

receiving an input that specifies a plurality of different locations within the residence that the associated remote control device is to be utilized;

outputting for display a prompt that requests identification of a location of the plurality of different locations;

receiving an input that specifies a particular location of the plurality of different locations, to configure settings for the particular location;

receiving an indication that the associated remote control device is located at the articular location of the plurality of different locations;

transmitting to the associated remote control device a first calibration signal;

receiving a second calibration signal sent by the associated remote control device in response to reception of the first calibration signal;

recording a baseline measurement for the particular location to calibrate a base unit for locating the associated remote control device within the residence utilizing signal positioning;

transmitting a first location signal to a transponder of the associated remote control device, the associated remote control device utilizable to control operations of the base unit;

receiving a second location signal transmitted by the transponder of the associated remote control device in response to receipt of the first location signal; and calculating a location of the associated remote control device relative to the base unit based at least on a time the second location signal is received at least by the first receiver, a signal strength of the second location signal received at least by the first receiver, or a comparison of a phase of the second location signal received by the first receiver with a phase of the second location signal received by the second receiver.

2. The method of claim 1, further comprising determining a distance between the base unit and the associated remote control device by comparing the time the second location signal is received at least by the first receiver with an expected time.

3. The method of claim 2, wherein the second location signal comprises a plurality of signals that form a pattern.

4. The method of claim 3, wherein the time the second location signal is received comprises a start time when a first signal of the plurality of signals is received and an end time when a final signal of the plurality of signals is received.

5. The method of claim 1, further comprising determining a distance between the base unit and the associated remote control device by comparing the signal strength of the second location signal with an expected signal strength.

6. The method of claim 1, further comprising determining a direction of the associated remote control device from the base unit based at least on the comparison of the phase of the second location signal with the phase of the second location signal.

7. The method of claim 1, further comprising providing to a display device navigation information that describes a path to the associated remote control device based at least on the calculated location.

8. A system for locating a remote control device, comprising:

a display device;

a base unit, comprising:

at least one transmitter operable to transmit a first location signal;

at least a first and second receiver; and at least one processing unit; and an associated remote control device, comprising:

a transponder operable to receive the first location signal and transmit a second location signal in response to the second location signal;

wherein each one of the following is implemented by one of the display device, base unit, and associated remote control: receives an indication to implement a setup routine for locating remote control devices at a residence utilizing signal positioning; outputs for display a prompt that requests identification of a location within the residence that the associated remote control device is to be utilized; receives an input that specifies a plurality of different locations within the residence that the associated remote control device is to be utilized; outputs for display a prompt that requests identification of a location of the plurality of different locations; receives an input that specifies a particular location of the plurality of different locations, to configure settings for the particular location; receive an indication that the associated remote control device is located at the particular location of the plurality of different locations; transmits to the associated remote control device a first calibration signal; receives a second calibration signal sent by the associated remote control device in response to reception of the first calibration signal; and records a baseline measurement for the particular location to calibrate a base unit for locating the associated remote control device within the residence utilizing signal positioning; and wherein the at least the first and second receiver receive the second location signal and each one of the following is implemented by the at least one processing unit: (a) calculates a location of the associated remote control device relative to the base unit based at least on a time the second location signal is received at least by the first receiver, a signal strength of the second location signal received at least by the first receiver, or a comparison of a phase of the second location signal received by the first receiver with a phase of the second location signal received by the second receiver; and (b) provides to the display device navigation information that describes a path to the associated remote control device based at least on the calculated location.

9. The system of claim 8, wherein the transponder comprises a radio-frequency identification tag.

10. The system of claim 8, wherein the associated remote control device further comprises a power source that powers operation of the remote control device and the transponder is powered by a source other than the power source.

11. The system of claim 10, wherein the source is a transponder battery included in the transponder and the transponder battery is separate from the power source.

12. The system of claim 10, wherein the transponder is activated by and powered to transmit the second location signal by receipt of the first location signal.

13. The system of claim 8, wherein the base unit further comprises an output component operable to provide navigation information based at least on the calculated location to a display device.

14. The system of claim 8, wherein the at least one processing unit calculates a location of the associated remote control device relative to the base unit by:

determining a distance between the base unit and the associated remote control device by comparing the time the second location signal is received at least by the first receiver with an expected time and by comparing the signal strength of the second location signal received at least by the first receiver with an expected signal strength; and determining a direction of the associated remote control device from the base unit based at least one the comparison of the phase of the second location signal received by the first receiver with the phase of the second location signal received by the second receiver.

15. A computer program product, comprising:

a set of instructions, stored in at least one non-transitory computer readable medium, executable by at least one processing unit to:

receive an indication to implement a setup routine for locating remote control devices at a residence utilizing signal positioning;

receive an indication to implement a setup routine for locating remote control devices at a residence utilizing signal positioning;

output for display a prompt that requests identification of a location within the residence that the associated remote control device is to be utilized;

receive an input that specifies a plurality of different locations within the residence that the associated remote control device is to be utilized;

output for display a prompt that requests identification of a location of the plurality of different locations;

receive an input that specifies a particular location of the plurality of different locations, to configure settings for the particular location;

receive an indication that the associated remote control device is located at the particular location of the plurality of different locations;

transmit to the associated remote control device a first calibration signal;

receive a second calibration signal sent by the associated remote control device in response to reception of the first calibration signal;

record a baseline measurement for the particular location to calibrate a base unit for locating the associated remote control device within the residence utilizing signal positioning;

transmit a first location signal to a transponder of the associated remote control device, the associated remote control device utilizable to control operations of the base unit;

detect reception of a second location signal by the transponder of the associated remote control device in response to receipt of the first location signal; and calculate a location of the associated remote control device relative to the base unit based at least on a time the second location signal is received at least by the first receiver and a comparison of a phase of the second location signal received by the first receiver with a phase of the second location signal received by the second receiver.

* * * * *

UNITED STATES PATENT AND TRADEMARK OFFICE

CERTIFICATE OF CORRECTION

PATENT NO. : 8,587,416 B2
APPLICATION NO. : 12/905278
DATED : November 19, 2013
INVENTOR(S) : Harish Nair Rajagopal It is certified that error appears in the above-identified patent and that said Letters Patent is hereby corrected as shown below:

In the Claims:

Col. 9, lines 26-28, in Claim 1:

Please delete:

"receiving an indication that the associated remote control device is located at the articular location of the plurality of different locations;"

and replace with:

"receiving an indication that the associated remote control device is located at the particular location of the plurality of different locations;"

Signed and Sealed this
Sixth Day of May, 2014

Michelle K. Lee

Michelle K. Lee
*Deputy Director of the United States Patent and Trademark Office*